United States Patent [19]

DePierro

[11] Patent Number: 5,008,840

[45] Date of Patent: Apr. 16, 1991

[54] MULTI-ZONE MICROPROCESSOR FIRE CONTROL APPARATUS

[75] Inventor: Alfred V. DePierro, Woodbury, N.Y.

[73] Assignee: Napco Security Systems, Inc., Amityville, N.Y.

[21] Appl. No.: 199,772

[22] Filed: May 27, 1988

[51] Int. Cl.[5] ..... G08B 17/00

[52] U.S. Cl. ..... 364/550; 340/577

[58] Field of Search ..... 340/525, 577, 578, 579; 364/550

[56] References Cited

U.S. PATENT DOCUMENTS

| | | | |
|---|---|---|---|
| 3,665,461 | 5/1972 | Gnägi et al. | 340/509 |
| 3,866,202 | 2/1975 | Reiss et al. | 340/525 X |
| 4,172,252 | 10/1979 | Wiberg | 340/525 |
| 4,359,721 | 11/1982 | Galvin et al. | 340/525 |
| 4,423,410 | 12/1983 | Galvin et al. | 340/525 |
| 4,498,075 | 2/1985 | Gaudio | 340/525 |
| 4,751,498 | 6/1988 | Shalvi et al. | 340/525 X |

*Primary Examiner*—Parshotam S. Lall
*Assistant Examiner*—Edward R. Cosimano
*Attorney, Agent, or Firm*—Arthur L. Plevy

[57] ABSTRACT

There is disclosed a multi-zone microprocessor fire control apparatus. The control apparatus employs a microprocessor which monitors a plurality of zones. Each zone may be associated with a smoke detector and which smoke detector will provide a predetermined condition when smoke is present in a zone. The microprocessor is controlled to monitor each zone by scanning the zones in a predetermined sequence. The microprocessor is associated with the key pad. According to the present invention, the key pad is accessed by a serviceman who inserts a given code into the key pad indicative of a one man test mode. The microprocessor recognizes the selection of this mode and therefore anticipates receiving an alarm condition due to the fact that the serviceman, after accessing the key pad, will enter a selected zone to provide an intentional alarm at that zone. Based on the fact that the microprocessor recognizes the selection of this one man test mode, the microprocessor will expect an alarm from the selected zone and will notify the serviceman by providing an audible alarm after the serviceman has intentionally caused the alarm. In this manner the serviceman can access each of the zones selected to verify proper operation by intentionally causing an alarm at each zone without causing the system to provide a normal output alarm signal which would occur upon the existence of true smoke conditions in a zone. There are other modes of operation during this test mode which enable the microprocessor to selectively inform a serviceman of conditions at selected zones by enabling the serviceman to repair such conditions as necessary.

20 Claims, 8 Drawing Sheets

MULTI-ZONE MICROPROCESSOR FIRE CONTROL APPARATUS

BACKGROUND OF THE INVENTION

The term fire control is used to describe fire alarm generating equipment of the type which monitors premises or zones to sound an alarm upon detection of fire or smoke.

This invention relates to a fire control system and more particularly to a fire control system which employs a microprocessor.

As one can ascertain, there are many systems in the prior art which are used to monitor fire conditions on a particular premise. Such systems generally employ smoke detectors or temperature responsive devices which monitor smoke or heat conditions in a desired area or zone. When a temperature is exceeded, or upon the detection of smoke, these systems operate to sound an alarm and/or to notify a central station of a possible fire or a dangerous condition.

As one will ascertain, there are many systems which employ sophisticated digital and analog circuitry in order to monitor premises to provide warnings of possible fire conditions. Such systems sound appropriate alarms upon detection of such conditions. These systems are widely employed and employ many different techniques to provide for such zone or system monitoring.

As will be described, the present system is a multi-zone microcomputer based fire control system which includes provisions for communications with a central station or a remote location to transmit an alarm condition. The system to be described includes a microprocessor and a preprogrammed PROM (programmable read only memory) and includes an integral multi-function digital key pad. As will be described, the system has certain features which are believed to be novel and unique and not included in any prior art designs.

One particular feature of the present system is the provision of a one-man testing mode. In this mode a single operator or user of the system can test the operation of various monitored zones without the assistance of additional personnel. In such prior art systems, during a test mode, at least two technicians were necessary to perform the testing of such systems. A first technician would enter the monitored premises and, for example, blow smoke into a smoke detector. The blowing of smoke into the detector produced an alarm condition. If the detector operated properly and the system was intact, the alarm or bell would sound indicating that the system detected smoke as expected. Another technician would wait by the control panel to silence the alarm once smoke was blown into the detector. The technician would then attempt to rid the smoke chamber of the smoke detector from the smoke by either blowing into the detector or by blowing air into the smoke chamber. If this was satisfactorily accomplished, an additional alarm would not be produced. If the technician failed to complete this task satisfactorily, the system would again alarm requiring the other technician again to silence the system by means of the control panel.

Thus, as one can ascertain, the use of two technicians to test the system was relatively expensive in that two experienced men were required to perform such tests in prior art systems.

It is an object of the present invention to utilize a one-man test mode in a microprocessor controlled system. In this manner a single operator can perform system tests in order to check the operation of smoke detectors associated with the system or to further check for faulty wiring, as will be explained.

By the use of the microprocessor, one can also implement various other desirable modes as will be described with regard to the present system.

It is therefore an object of the present invention to provide a new and improved fire control system employing a microprocessor to enable the system to provide different modes of operation thereby providing an economical and rapid means of testing the system.

BRIEF DESCRIPTION OF THE PREFERRED EMBODIMENT

In a fire control system of the type including a plurality of zones to be monitored, each zone associated with a smoke detector and arranged as a two wire loop with said smoke detector positioned across said two wires to provide a short upon detection of smoke, with each zone monitored by processing means operative to scan said zones in a determined sequence to respond to the condition of each loop in each zone in order to determine the presence of an alarm in said zone manifested by said smoke detector activation providing a short across said wires, whereby if said alarm continues said processing means will provide an output indicative of said alarm, the combination therewith of apparatus for testing system operation in a one man test mode, comprising: first means coupled to said processing means and operative to inform said processing means of said selection of said one man test mode; means responsive to said selection to cause said processing means to wait a given period before providing an alarm output during said one man test mode to enable a serviceman to intentionally provide an alarm in a zone by activating said associated smoke detector; second means coupled to said processing means operative to cause said processing means to provide an output indicative of said intentionally provided alarm to thereby notify said serviceman of the same.

DETAILED DESCRIPTION OF THE DRAWINGS

Figure 1:
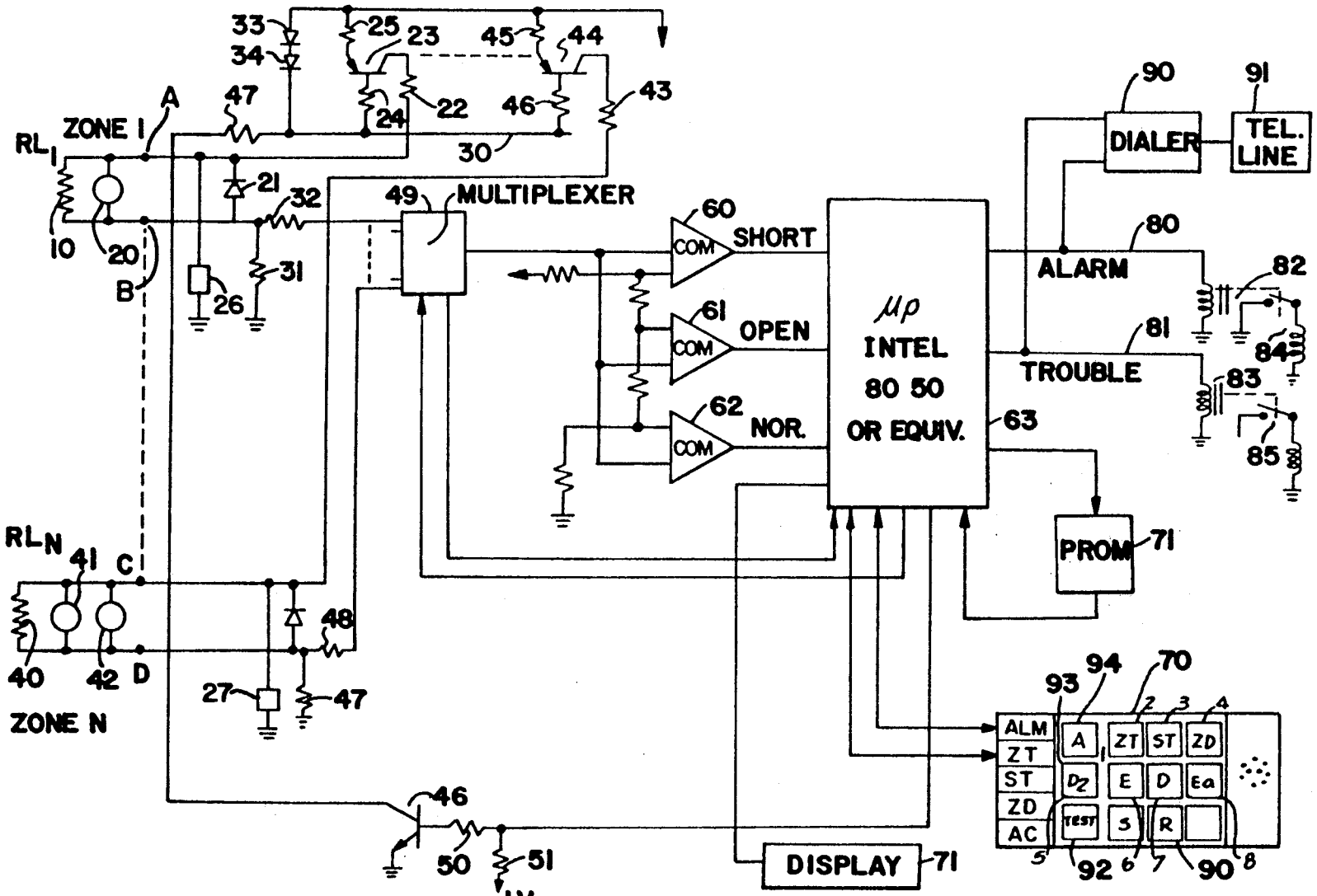
FIG. 1 is a detailed block diagram of a multi-zone microprocessor fire control apparatus according to this invention.

Referring to FIG. 1 there is shown a block diagram of a microprocessor fire control system according to this invention. As seen in FIG. 1, the system operates to monitor various zones designated as Zone 1–Zone N. Each zone, for example, may monitor a particular location in a building. The location may be a room or may be an entire building or other area. Each zone includes a two wire loop (Zone 1) which loop is monitored as will be explained to determine an alarm or trouble condition. As seen in FIG. 1 each loop is terminated by means of a load resistor. The load resistor 10, designated as RL 1 for Zone 1, assures that a current will always flow through the loop and for each zone. In shunt with the load resistor 10 is a smoke detector 20. The smoke detector 20 is a relatively conventional device and, for example, may be an ionization detector or a photoelectric detector. In any event, the smoke detector 20 as appearing across the loop for Zone 1 will create a short circuit across the lines or across terminals A and B upon the detection of smoke.

As seen, the terminals A and B are directed to the control panel with terminal A and terminal B coupled together via a diode 21. The terminal A is directed through a resistor 22 to the collector electrode of a transistor 23. Terminal A is also directed to ground through a lightening or noise protection device such as a varistor 26. This device as indicated by a box is at relatively high impedance until subjected to a high voltage or noise pulse. The base electrode of transistor 23 is returned through a resistor 24 to a control terminal 30. The terminal B, as seen in FIG. 1, is returned to ground through a resistor 31 which has its other terminal coupled to one terminal of a resistor 32 which provides an input to a multiplexer device 49.

As will be explained, and as shown in FIG. 1, the system and apparatus to be described is capable of providing multi-zone operation. Therefore, the dashed lines indicate the presence of more than one zone. As shown in FIG. 1, there is a Zone N, which essentially is of the same configuration as Zone 1. In this manner, the Zone N loop contains a terminating resistor 40 which is shunted by smoke detectors as 41 and 42 where the loop is connected across terminals C and D. Terminal C is connected to a resistor 43 in series with the collector electrode of a transistor 44. The transistor 44 has an emitter electrode directed through resistor 45 to the +V supply and has a base electrode directed through resistor 46 to the control terminal 30. Terminal C is also directed to ground through a lightening or noise protection device such as a varistor 27. This device as indicated by a box is at relatively high impedance until subjected to a high voltage or noise pulse.

As one can ascertain, the D terminal of Zone N is connected through the voltage divider consisting of resistors 47 and 48 with resistor 48 again coupled to one input of the multiplexer 49. The dashed lines shown in FIG. 1 indicates that there is more than one zone and, for example, a typical fire control apparatus according to this invention may accommodate four zones.

As seen, the control terminal 30, which is coupled to the base electrodes of transistors 23 and 44 via resistors 24 and 46, is coupled through a resistor 47 to the collector electrode of a transistor 48. The base electrode of the transistor 48 is suitably biased by means of resistors 50 and 51 with the common terminal between resistors 50 and 51 directed to an output of the microprocessor 63.

As indicated above, the circuit configuration for each zone is identical. Each zone may include one or more smoke detectors as 20, 41 and 42 and essentially each zone receives a biasing current from the associated transistors as 23 and 43. Thus, as will be explained, the normal condition of transistor 48 is that the transistor is rendered conductive. In this manner transistors 23 and 44 both conduct, thereby allowing a current to circulate within each of the loops associated with the zones. The circulated current develops a voltage across the respective resistors as 31 and 47 which voltage is applied to the multiplexer. If system operation is normal the voltage across resistors 31 and 47 is indicative of a particular value which indicates normal circuit operation.

As one can see, if a loop were open, as for example the removal of the resistors 10 or 40, the voltage across resistor 31 would disappear, hence indicating an open circuit which condition is applied to the input of the multiplexer 49. In a similar manner, if any of the smoke detectors as 20 and 41 were activated, this would appear as a short circuit across terminals A and B or terminals C and D. The short circuit would of course increase the voltage across resistors 31 and 42 and this increased voltage would be indicative of a short circuit voltage also applied to the multiplexer input.

The multiplexer 49 is a common device and is controlled by the microprocessor 63. In this manner the microprocessor 63 selectively activates the multiplexer so that each zone, as Zone 1 to Zone N, is in turn monitored at the output of the multiplexer 40 as controlled by the microprocessor. The output of the multiplexer 49 is connected to three comparators designated as 60, 61 and 62.

The comparators as 60, 61 and 62 each operate to determine the condition on each scanned zone, as for example a short circuit condition by comparator 60, an open circuit condition by comparator 61 and a normal operation condition from comparator 62. The comparator outputs are coupled to inputs of the microprocessor 63. The microprocessor 63 is a conventional device such as an 8050 available from Intel Co. and has multiple input data lines, address lines and multiple output lines. The microprocessor 63 essentially has a portion of its memory reserved for the status of each of the zones. As one can easily understand, the microprocessor 63 controls the multiplexer via its control input and therefore enables the multiplexer to apply the voltage from each zone from the input to the common output. Thus the microprocessor will have stored for Zone 1 a past state of the zone as obtained during the last scan. If this state of the zone changes then the microprocessor will know that a change occurred in each particular zone.

For example, during normal operation if all zones are intact and all terminating resistors as 10 and 40 are in circuit, each zone will produce a normal operating voltage across its respective resistor as 31 and 47. This normal operating voltage will be applied to the output of the multiplexer when that zone is selected. In this manner the microprocessor 63 will note that all zones are in normal operating conditions.

If an alarm occurred, such as to cause a smoke detector as 20 or 41 to operate, then this will produce a short circuit across the terminals as A and B for Zone 1. The voltage, due to the short circuit, will appear across resistor 31 for Zone 1. Hence, during the next scan of this zone the multiplexer output will indicate a higher voltage indicative of a short circuit. In this manner the microprocessor knows the status of each zone via the comparators 60 to 62 as coupled to the microprocessor and as selected according to the zone by means of the multiplexer 49.

As will be explained, the microprocessor 63 also has access to a key pad and control panel 70. Essentially the key pad 70 is a typical key pad which is associated with many prior art control panels. The key pad 70 has a plurality of keys which can be accessed by a user of the panel with each key, as indicated, capable of performing a different function.

The key pad 70 also contains five LED's or light emitting diodes, a numeric display 71 and the ten push buttons, as shown. The numeric display 71 may be an LED or LCD display of the 7 segment type to enable the display of numbers as 0–9 as will be explained. The LED's indicate alarm, zone trouble, system trouble, zone disabled and AC on. The numeric display 71 will indicate the number of the zone in alarm, the zone in trouble or the zone or zones that have been disabled. There are various system troubles which correspond to different numbers which are also shown on the numeric display. These display indications are relatively conventional.

The operation of the microprocessor 63 in conjunction with a keyboard or key pad 70 and the indicator panel are also conventional types of arrangements found in many control panels as those including burglar and fire alarm systems.

For examples of key pads which are employed in such intrusion detection systems, reference is made to U.S. Pat. No. No. 4,498,075 which issued on Feb. 5, 1985 entitled "Fault Indicator Apparatus From Multi-zone Intrusion System" and assigned to Napco Security Systems, Inc., the assignee herein. Reference is also made to U.S. Pat. No. 4,667,183, issued on May 19, 1987 entitled "Keyboard Hold Down Functions For A Multi-zone Intrusion Detection System" assigned to Napco Security Systems, Inc., the assignee herein.

As one can understand, the operation of a keyboard in conjunction with an intrusion detection system as well as a fire detection system is well known. It is important to note that the key pad 70 interfaces with the microprocessor, hence the microprocessor 63 can determine which keys have been activated. This enables the microprocessor to decipher the mode of operation desired by the accessing of the key pad 70. The microprocessor 63 also interfaces with the display panel 71 and the LED display in order to illuminate the various indicator lamps and to display the zone or alarm conditions.

The microprocessor 63 is also associated with a PROM 71 which PROM can be conventionally programmed as is known in the art by a system user.

The microprocessor 63 also provides an alarm output via output 80 and a trouble output via output 81. Both the alarm and trouble outputs are associated with conventional relays such as 82 and 83 which relays will operate to activate a bell 84 in the case of an alarm or a buzzer or other type of indicator 85 in the case of a trouble. The alarm indication is selected to be different than a trouble indication.

Both the alarm and trouble indicators are directed to a digital dialer apparatus 90 which can access a conventional telephone line 91 to transmit a trouble indication or an alarm indication to remote locations such as a central office and so on. Digital dialers as 90 which are coupled to telephone lines 91 are also well known in the security art. It is also well known that audible alarms are provided upon the indication of an alarm or a trouble condition by prior art systems.

As will be further explained, an alarm indicates that a particular zone has detected the presence of a dangerous condition such as the activation of a smoke detector or the activation of a manual pull alarm indicating the presence of a fire. The system will also detect trouble conditions, for example, if a wire is opened thus rendering a zone inactive. Thus, by an opened wire in Zone 1 there would be no current flow and hence the entire zone is rendered inoperative. This will constitute a trouble condition which should be indicated at the control panel via the display 71 or by further sounding an alarm as a trouble alarm via relay 83 or by further sending this information via the dialer 90 to the central station 91 so that the trouble condition can be attended to by the user or by a service technician.

With the above in mind, there will be given a description of the operation of the zone circuits in regard to the associated smoke detectors, such as 20 and 41, associated with Zone 1 and Zone N. As indicated above, each zone has its own current limiting circuit. The circuit for Zone 1 consists of transistor 23, resistors 25 and 24. In a similar manner resistor 45 and resistor 46, in conjunction with transistor 44, perform current limiting for Zone N.

As one can ascertain from FIG. 1, when a two-wire smoke detector, such as 20, goes into alarm it basically provides a short circuit across terminals A and B. The current is current limited by resistor 25. The diodes 33 and 34 are connected in series with diode 34 having its cathode connected to resistor 47 which is connected to the collector electrode of transistor 48. The diode 34 compensates for the emitter to base junction of the transistors. Thus the current in each of the zones is limited by the above-noted circuit components.

It is noted that if one assumes that the base current through resistor 24 is small then that voltage drop can be neglected. As indicated, transistor 48 operates so that the normal state of the transistor is such that it is turned on which therefore indicates a collector voltage which essentially is at ground. Thus the terminal of resistor 47 is at ground and loop current flows through each loop as limited by the above-noted components.

After system installation, a technician may blow smoke into a smoke detector to test system operation. This will cause the smoke detector, such as 20, to provide a short circuit across terminals A and B. Another technician will be at the control panel as is typical of prior art systems. Once the smoke detector 20 is activated an alarm output on output lead 80 of the microprocessor, will cause the relay 82 to operate, thus sounding the alarm bell. The technician at the control panel will then press the reset button 90 (R) associated with the control panel. Pressing the reset button 90 on the key pad 70 will initiate a reset cycle. This activation of the reset button 90 is detected by the microprocessor 63. The microprocessor then sends a pulse to the base electrode of transistor 48 turning the transistor off or non-conductive.

As one can ascertain, when transistor 48 is rendered non-conductive the current flow ceases through transistors 23 and 44. Thus during this mode no current flows through any of the zones because transistors as 23 and 43 are also turned off. The microprocessor 63 sends a four second duration pulse to the base electrode of transistor 48, thus turning the transistor off for four seconds. Hence power is removed from each of the zones for this four second period. The period of four seconds is enough time for the smoke detector to unlatch itself if it was in alarm. At the end of the four second period the microprocessor then turns transistor 48 back on thereby operating transistors 23 and 44 in the on condition. Thus the circuits again have a current flow through the respective loops.

The microprocessor now performs a delay which is determined by the contents of a problem location storage area located in PROM 71. This delay is really the time it takes for a given type of smoke detector to reset. As one can ascertain, certain smoke detectors will reset in two seconds, some smoke detectors may take ten or fourteen seconds or greater. This means that after power is restored to the zone the control panel must wait an amount of time before it can actually determine the true state of the smoke detector. If the smoke was cleared from the chamber of the smoke detector the smoke detector will have reset. If there is still smoke in the chamber the smoke detector will realarm in that period of time. Thus, what occurs is that as soon as power is reapplied to the zones the smoke detector will not activate in the alarm state immediately. If it comes up in the nonalarm state, after the above-described interval of four seconds and does not realarm until after its processing time, there is not a problem. Thus if the zone was not in alarm after the four second interval, the control panel is cleared.

As indicated above, ionization smoke detectors may reset in two seconds but photoelectric detectors may take much longer. In any event, by programming the PROM 71 one can select, in the appropriate area of the PROM, the exact necessary time to allow the smoke detector to completely clear during a reset interval. In this manner one has the capability of utilizing different times by programming the PROM accordingly. As one can understand, this provides great convenience to the installer in that he is able to prevent the panel from realarming in the case that smoke is not actually cleared from the detector by waiting the predetermined period. This period can be programmed by the installer via PROM 71.

As indicated, as soon as power is reapplied to the smoke detector the smoke detector does not come up in the alarm state immediately. It comes up in the nonalarm state and does not realarm until after its processing time which, as indicated above, may be from 2 to 10 or 14 seconds or more. For example, in certain control panels the operation would require a wait for a fixed amount of time which may be 4 seconds before the microprocessor evaluated the zone condition. If the zone was not in alarm the control panel would be cleared, the displays would be cleared and the fire alarm indication would be cleared. Thus, if a smoke detector took longer to reset then 4 seconds and, for example, required 10 seconds then after 10 seconds the smoke detector would go back into alarm, the control panel would realarm and the alarm bells would again trip causing a fire alarm indication on the premises.

Therefore an installer who knows the type of smoke detector he is using can program into the PROM 71 the proper amount of time that it takes for the smoke detector to realarm after power is reapplied to the smoke detector. In this manner the installer completely prevents the false alarm as indicated above.

In any event, let us assume that there is still smoke in the chamber of the smoke detector after the four second period so that the smoke detector will realarm at the end of its processing time. The control panel via the microprocessor 63 normally provides a smoke detector delay time that also was programmed into PROM and at about 1.75 seconds before that time is up the control panel, via the microprocessor, indicates that the zones be evaluated to see if there is a fire alarm condition and that it is a proper input. In this manner the microprocessor 63, during the 1.75 seconds, will access the affected zones via the multiplexer 49. The microprocessor will then enter a normal integration time interval to evaluate whether there is a real alarm or whether there is a noise pulse on the zone that caused the alarm indication. This zone integration time is approximately 1.25 seconds and upon completion of that integration time the microprocessor will then indicate that the alarm condition has not been reset and therefore the display will not be reset and the alarm relay will not be reset. This indicates the presence of an actual fire condition in regard to that zone.

Let us now assume that the smoke detector delay time is just about complete and that the panel now is reevaluating the zone condition but this time the smoke detector has reset so there is no short across the zone input terminals. In this case the microprocessor receives no alarm condition to evaluate and therefore it does not go through its zone integration cycle and hence at the end of the smoke detector delay time the microprocessor removes the zone number from the display 71 and assuming that there are no other zones which have shorted conditions it will turn off the alarm relay indicating that this is a no alarm condition.

Thus one of the major differences between the above-described operation and the operation with prior art control panels is essentially that the time after power is removed from the smoke detectors and then reapplied to the smoke detectors can be made a variable time which is programmed in the PROM 71. In other control panels this time is usually a fixed time. It may be 2 seconds or 4 seconds but in general it is a fixed amount of time which does not allow the system to accommodate different types of smoke detectors.

Hence, as one can understand from the above description, for a typical installation, as for example in testing various smoke detectors, the above described operation normally requires two technicians. One technician accesses the location of each of the smoke detectors and blows smoke into the same while the other technician presses the reset button on the panel to silence the alarm. Thus, as one can see, the above-described operation is relatively typical of a fire control panel operation requiring at least two technicians to perform the test procedures.

Figure 2:
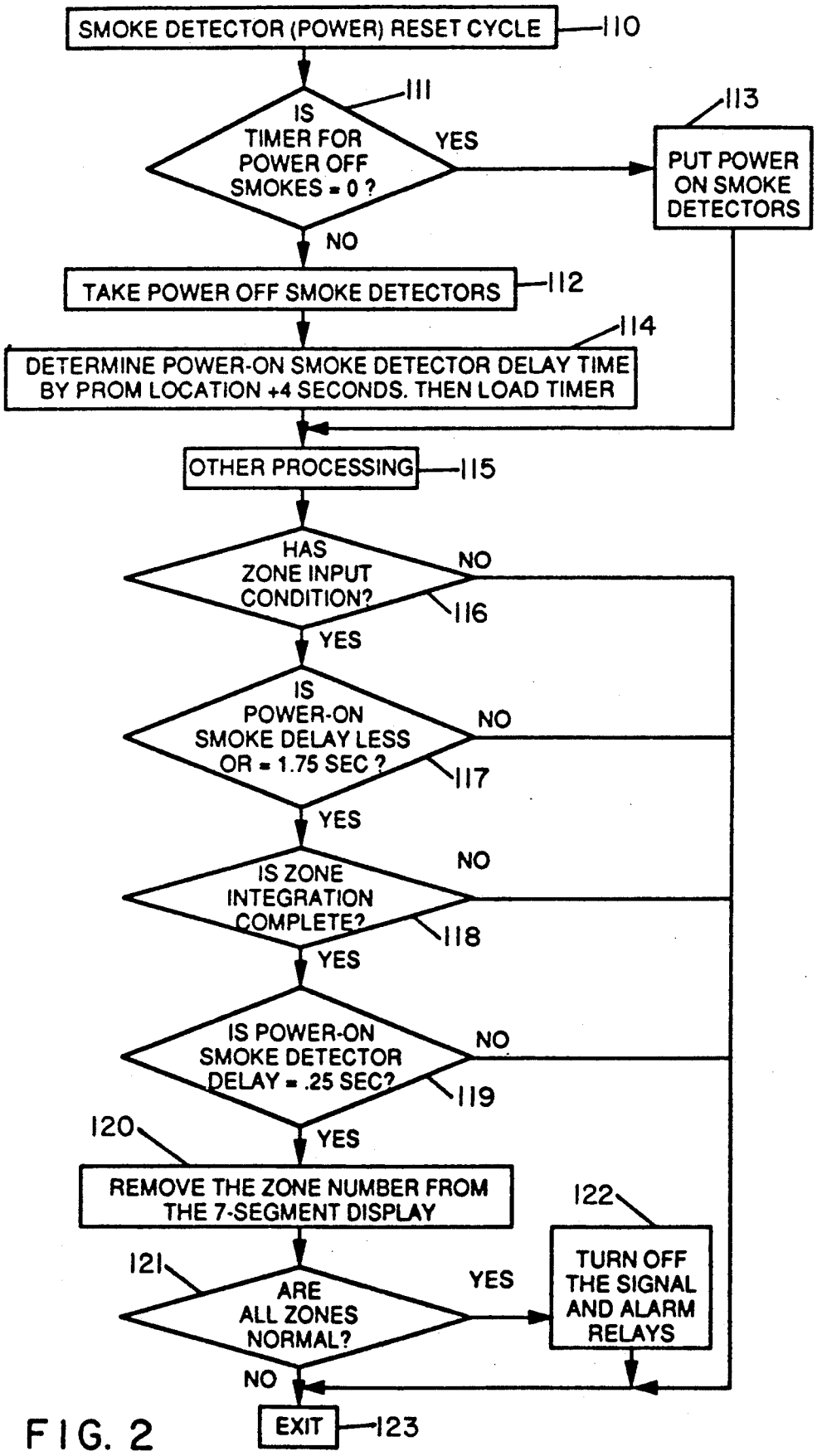
FIG. 2 is a flow chart depicting a smoke detector reset cycle implemented by the apparatus shown in FIG. 1.

Referring to FIG. 2 there is shown a flow chart depicting the above-described operation. The flow chart of FIG. 2 should enable one to more fully understand the above-described operation and how the microprocessor functions to complete the assigned tasks. The microprocessor 62 may be a conventional component such as the Intel 8050 microprocessor.

FIG. 2 shows the flow chart for the smoke detector power rest cycle described above. Essentially, reference numeral 110 refers to the program. As indicated, a timer is set for four seconds as indicated by module 111. If the timer is off then power is placed back on the smoke detectors as indicated by module 113. For power to be applied to the smoke detectors requires that the 4-second time as indicated by module 111 is in the Off condition. If the timer is not in the Off condition then this means that a one-man test is being performed. Hence, as indicated by module 112, power is removed from the smoke detectors for the 4-second period, but the processor knows which zone is being tested, and can now address the PROM and specify a new length of time greater than four seconds as associated with the particular smoke detector located at the test location. This is shown in module 114 where the power On smoke detector delay is computed by accessing the suitable PROM location and adding the smoke detector typical delay time plus four seconds. Thus, a new timer is loaded which timer will have a sufficient time greater than four seconds to assure that the smoke chamber would be cleared. The system continues to do other processing after the timer has been loaded as indicated by module 115.

As indicated above, after power has been restored to the detectors, the system now must wait that amount of time before it can actually determine the true state of the smoke detector which was violated. If the smoke was cleared from the chamber, the smoke detector will have reset. If there is still smoke in the chamber, the smoke detector will still be on in that period of time. Thus, as indicated above, when power is reapplied to the smoke detector, it does not come up in the alarm state immediately. It comes up in the non-alarm state and does not realarm until its actual processing time. Thus, the microprocessor goes back to the violated zone and determines whether there is still an alarm condition as determined by module 116. If there is no alarm condition then everything is normal and one exits. If there is still an alarm condition at that zone, the microprocessor the looks at the zone abut 1.75 seconds before the time for that smoke detector is terminated. The microprocessor is programmed to determine whether or not there is a fire alarm condition on that particular zone and this is indicated by modules 116 and 117. Module 116 of FIG. 2 states "Has zone input condition?" determining whether the zone has the input alarm condition still present. If there is still a problem with the zone and there is less than 1.75 seconds to go then the system performs zone integration as shown in module 118. If there is still an alarm, the microprocessor goes through its normal integration time to evaluate whether it is a real alarm or just a noise pulse on the zone that caused the alarm. The zone integration time is approximately 1.25 seconds. Upon completion of that integration time, the microprocessor will again indicate that the alarm condition has not been reset, and, therefore, the display will not be reset and the alarm relay will not be reset as indicated by module 119. If the smoke detector delay time is completed or approximately completed, assume there is .25 seconds left to go as indicated by module 119 and the smoke detector has been reset so that there is not short circuit across the zone input terminals, and hence there is no alarm. In this case, the control panel has no alarm condition to evaluate and therefore does not go through its zone integration cycle as indicated by module 118 and what it does at the end of the smoke detection delay time is to remove the zone number from the 7-segment display as indicated by module 120, and assuming that there are no other zones which have shorted conditions, it will turn off the signal and the alarm relays as indicated by module 122 and exit from the program. If all zones are not normal as indicated by module 121, then one exits via module 123 without turning off the signal and alarm relays. The "NO" output from boxes 116, 117, 118, 119, and 121 are all directed to the exit module 123. A "NO" from any of these boxes requires an exit from the smoke detector reset cycle routine. Thus, as one can see, the flow chart of FIG. 2 is in complete conformity with the above-noted description.

The system shown in FIG. 1 is capable of providing a one man test operation. In this manner a single technician can test the system to determine proper operation of the smoke detectors and to further check zone wiring. To invoke this test mode the user accesses the key pad 70. The first procedure that is implemented is that the user disables the zone to be tested by pressing the disable zone key 93. The key 93 is then followed by the depression of the zone number, such as Zone 1 for disabling Zone 1, Zone 2 for disabling Zone 2 and so on. This procedure is repeated for each zone to be tested. Essentially the depression of key 93 followed by a particular zone informs the microprocessor that that zone is to be disabled. What is meant by this is that the microprocessor does not respond to alarm conditions emanating from that zone due to the fact that the zone is disabled during this test procedure.

The operator then presses key 92 which is the test key and then presses the 1 key which is key 94 indicating that this is a one man test. The microprocessor recognizes the one man test mode by the fact that key 92 was depressed followed by the depression of key 94. The operator, after implementing the above depressions of the key pad, now accesses the proper zone by going into the zone area and activating or putting the zone into an alarm condition. For example, the operator, after implementing the above-noted key depressions, will then enter Zone 1 and blow smoke into the smoke detector 20. This causes a short circuit to appear across terminals A and B and causes the microprocessor to recognize the short via comparator 60. Since the microprocessor also knows that this is a test mode and that Zone 1 has been disabled, the microprocessor will then cause the alarm device to pulse two times.

This alarm indication is implemented by means of the alarm output 80 from the microprocessor. In any event, the operator will hear two bell rings and therefore immediately ascertain that the system has responded to the intentional alarm condition forced in that zone. After about a 30 second period the microprocessor 63 determines whether the zone is still in an alarm condition. If the zone is still in an alarm condition the smoke detector power will automatically be removed for 4 seconds in an attempt to reset the alarm condition.

Thus the microprocessor 63, after a 30 second interval during the one man test mode, will now provide a pulse to turn transistor 48 off as above described and hence remove power for 4 seconds in an attempt to reset the alarm. Thus after the smoke power up time, which may be 2 seconds plus any programmed additional time, if the alarm condition is reset, indicating that the smoke detector is now in a normal state, the signal circuit alarm device will pulse once or sound once. This indicates satisfactory operation of the smoke detector for the selected zone. After the satisfactory testing of the smoke detector the technician can now place the zone into trouble by intentionally opening the loop. By opening the loop, the microprocessor 63 will detect the open and still knowing that this is a one man test mode will now cause the trouble alarm to sound or be pulsed two times via output 81. The technician will then verify that this is correct.

In any event, if the loop was previously opened due to an actual malfunction, the technician in this mode can now check or determine the malfunction by moving wires or moving components to see if he can locate the opening. When the opening is located and fixed, the system will detect the transition from the open condition to the normal condition and this will be indicated automatically by means of an alarm. Hence, in the one man test mode as described above, a single technician can test zones and receive audible indications that the various test procedures have been implemented by listening to the audible signals which emanate from the system in the one man test mode.

Figure 3:
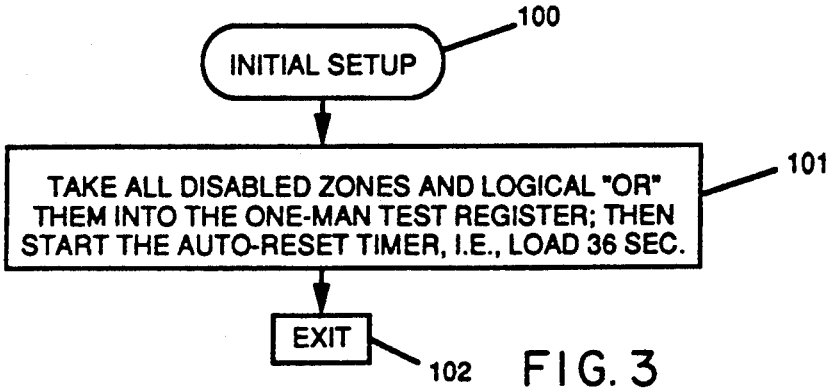
FIG. 3 is a flow chart showing an initial setup indicative of a one-man test mode which is implemented by the system of FIG. 1.

Referring to FIG. 3, there is shown the initial procedures which occur upon implementing a one-man test mode. As indicated above, the operator presses the test button and then presses the one button. This one-man test is initiated and the system via the microprocessor sets up a one-man test register which is a register located within the microprocessor. This test register defines which zones are part of the one-man test function.

Referring to FIG. 3, there is shown the initial set-up module 100. As indicated, the operator presses the test button and then depresses the one button after disabling the zones to be subject to the one-man test. The logic module 101 indicates that the system via the microprocessor takes all disable zones and logical ORs them into the one-man test register. At this point, the microprocessor starts an automatic reset timer whereby this timer is loaded with a time of about 36 seconds. This time corresponds to the 30 second period as described above. The next step is that the system then exits this procedure indicated by module 102.

As one will understand, the microprocessor essentially operates to perform a main-line processing sequence which is a series of specific tasks that the microprocessor performs where each task is performed in sequence from a start task to an end task and then the microprocessor completely repeats the cycle. This cycle is shown in FIG. 4.

Figure 4:
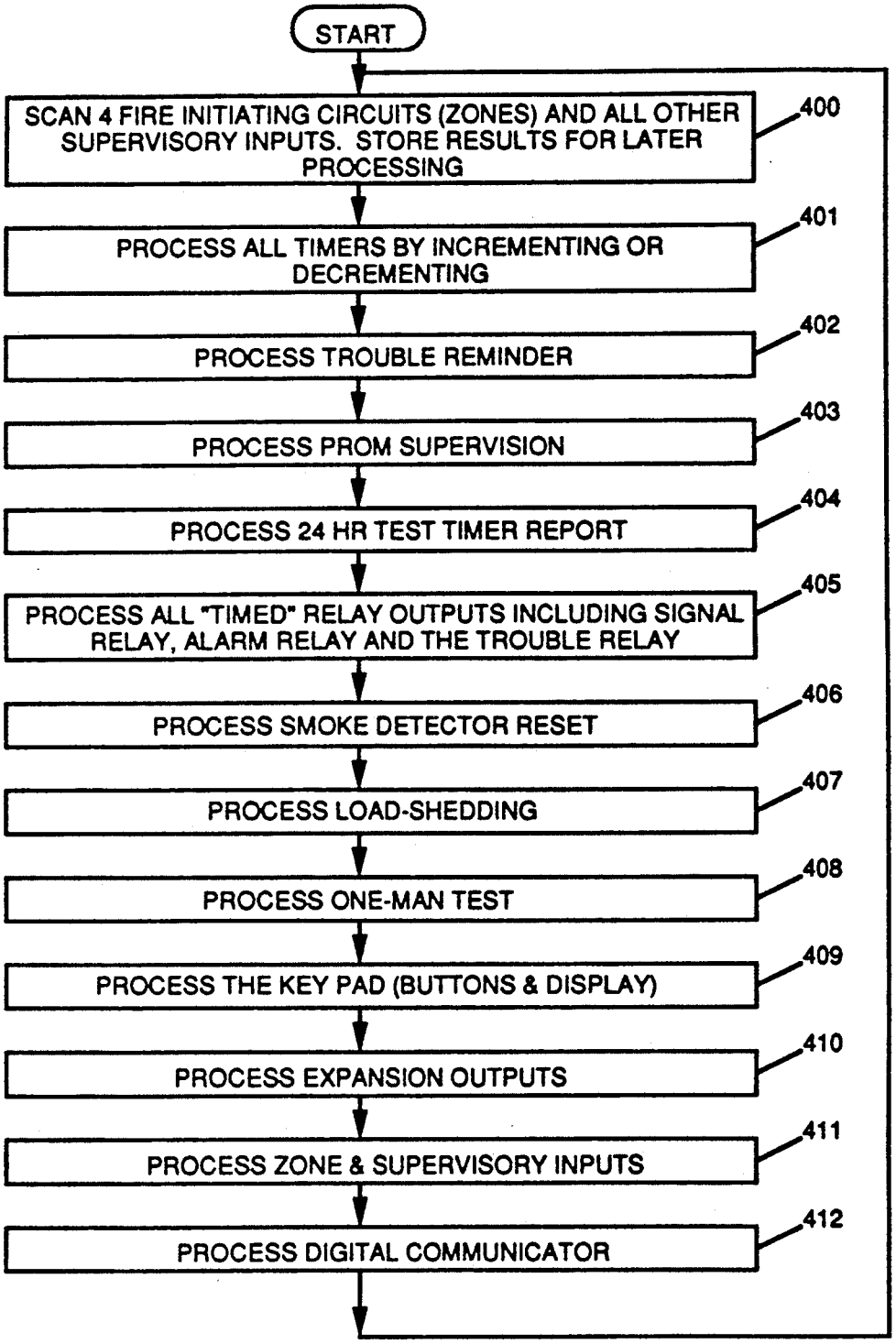
FIG. 4 is a flow chart depicting the main line processing as implemented by the microprocessor included within this system.

Hence, as seen from FIG. 4, upon a start condition, the first thing that the microprocessor does is to scan the fire initiation circuits or the zones, as for example zone 1 to zone n and all other supervisory inputs. The microprocessor, during this sequence, stores the status of each zone in memory. This is indicated by module 400. The next routine is that the microprocessor will process all timers by incrementing or decrementing the timers within the microprocessor according to the features of the system, and this is indicated by module 401.

During the next processing mode indicated by module 402, the microprocessor will process the trouble reminder. During the processing indicated by 403, the microprocessor will process the PROM in regard to supervision commands. During the next processing mode 404, the microprocessor will process a 24-hour test time report. During the processing time 405, the microprocessor will process the timed relay outputs including the alarm relay and the trouble relay. During the next processing mode indicated by module 406, the microprocessor will process smoke detector reset as for example explained above and shown in FIG. 2. Then the microprocessor in step 407 will process load shedding. Then in 408 the microprocessor will enter and process the one-man test routine.

It is understood that one main aspect of this invention is the one-man test routine which the microprocessor enters in regard to the mainline processing step indicated by module 408. In step 409 the microprocessor will process the key pad to determine what buttons have been depressed and what entries should be made on the displays. In 410 the microprocessor will process expansion outputs. In 411 the microprocessor processes zone and supervisory inputs, while in 412 it processes the digital communicator to determine whether any message is to be sent over a telephone line for example. The entire procedure then starts again.

Reference has been made to FIG. 4 to show main-line processing so that one can clearly understand that a one-man test mode is implemented, the microprocessor will go through the main line processing as shown in FIG. 4 and will then recognize the one-man test mode when it comes to processing level 408. As one can understand, the depression of the buttons via the key pad occurs during the step 409 (FIG. 4) where the microprocessor will store the keys depressed for the one-man test procedure and will implement the same during the one-man test processing mode indicated by step 408. This is a conventional operation of a microprocessor as it is understood that the microprocessor performs main line processing functions as indicated in FIG. 4 in sequence.

Figure 5:
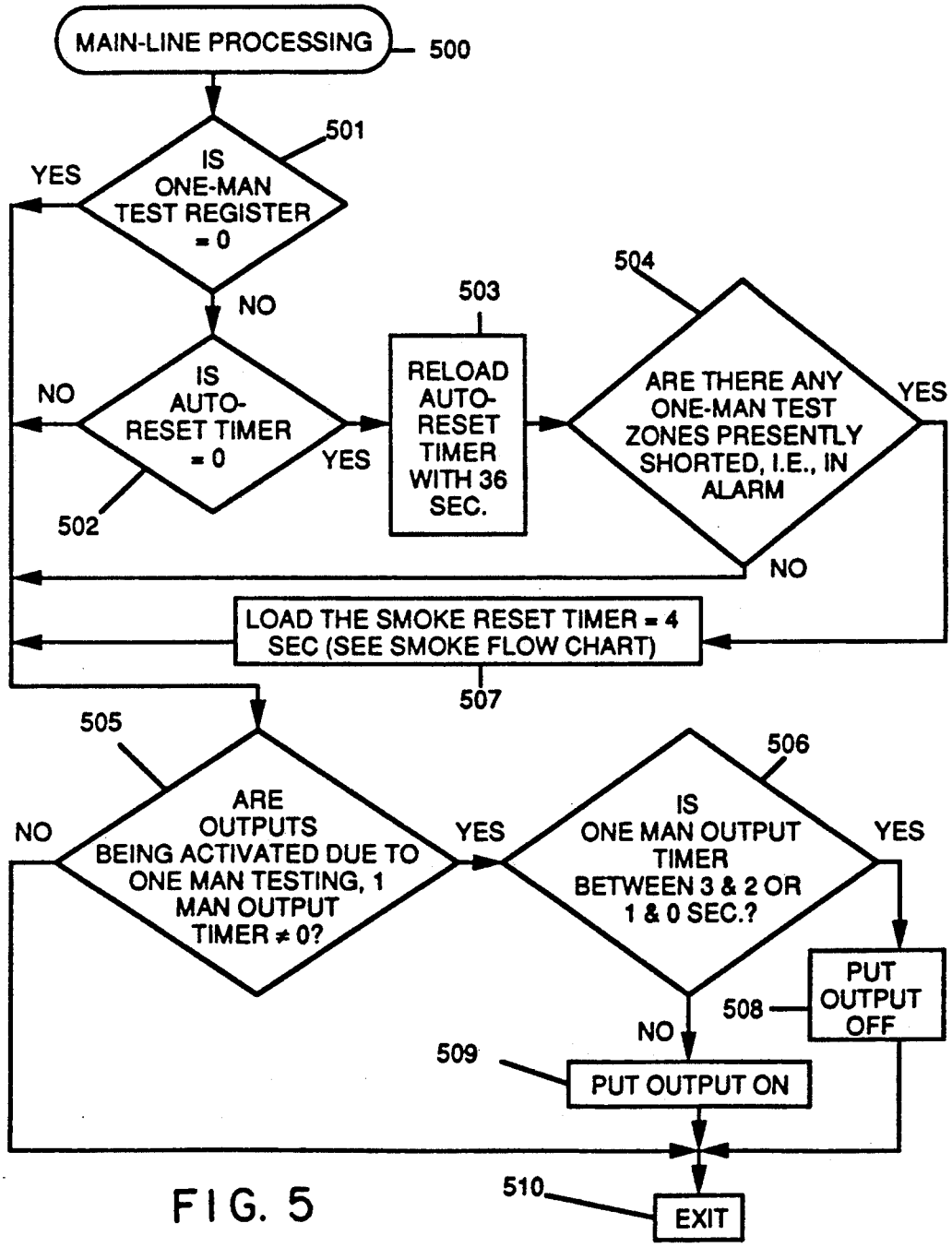
FIG. 5 is a detailed flow chart depicting a one-man test processing mode implemented by the system.

Referring to FIG. 5, there is shown the main line processing function indicative of module 408 of FIG. 4 which is the process one-man test. Thus, as shown in FIG. 5, module 500 represents step 408 in FIG. 4 which is the main line processing sequence. When the microprocessor begins to process the one-man test, the first thing that the microprocessor does is determine whether the one-man test register which was described in FIG. 3 is equal to zero. If it is equal to zero then that means there is no data in that register, and hence the processor goes to module 505 to determine whether there are outputs being activated due to one-man testing.

As will explained, during the one-man test procedure, the system still operates in regard to the zone processing step which is indicated in FIG. 4 by module 411. The zone processing flow chart as will be subsequently explained shows the one-man test outputs which are set up for pulsing the alarm and trouble relays two times or one time depending upon the condition detected during the one-man test. For example, as indicated above, when the operator puts a selected zone into an alarm by, for example, blowing smoke into the smoke detector, the alarm circuit or alarm device will pulse twice. If after the smoke power up time the alarm condition is reset, the signal alarm circuit will pulse once. Also as indicated above, if a zone is placed into a trouble condition, for example as having an opened loop then the trouble relay or the trouble alarm will pulses twice. If the condition is repaired, the trouble relay will pulse once indicating that the zone is repaired.

The one-man output timer as indicated in module 505 is a timer that is set to cause the alarm to produce two pulses or one pulse depending upon the above-noted conditions. As indicated by module 505, if outputs are being activated due to one-man testing based on the fact that the one-man output timer is not zero then module 506 is entered where it is determined whether the one-man output timer is between 1 and 2 seconds or between 3 and 4 seconds.

This is important so that the system knows whether or not the alarm is to be sounded twice or once. If the timer is between 3 and 2 or between 1 and 0 then the output is off for one second as indicated by module 508. If it is not then the output is on for one second as indicated by module 509. Once this is done then one exits this sub routine at 510. The outputs of modules 508 and 509 proceed to box 510 which is the exit. The program then proceeds to box 409 of FIG. 4 where the LED and 7 segment display is updated and where the keypad is sampled for any key presses.

Again referring to FIG. 5, if the one-man test register is not equal to zero as indicated by module 501 then one enters module 502 which states is the autoreset timer equal to zero. The autoreset timer is the 36 second timer as discussed above. If the autoreset timer is equal to zero then one reloads the autoreset timer with a 36 second period as indicated by module 503. After the autoreset timer is loaded with the 36 period, one then enters module 504 which states "Are there any one-man test zones presently shorted as in alarm?" If there are any one-man test zones shorted then one enters module 507 where one loads the smoke reset timer to 4 seconds. This sequence of 4 seconds is the above-described smoke timer sequence which was also shown in flow chart form in FIG. 2.

Thus, as one can ascertain, during the one-man test mode the above-described smoke detector reset sequence is automatically implemented due to the fact that the installer can blow smoke into the smoke detector to test operation. This is indicated by module 507. At the completion of the load smoke reset timer, one returns to module 505. As also indicated, based on other subroutines, one also returns to module 505 and then exits when the one man output timer is set to zero. The zone processing flow chart which will be described shows the one-man test outputs which are set up for pulsing the alarm two times or one time. If the alarm bells are pulsed twice then the one-man output timer is loaded with 4 seconds. If it is pulsed once then the timer is loaded for 2 seconds. In this way an alarm is 1 second on, 1 second off. Thus, to generate one alarm, one needs a 2 second clock with 1 second on and 1 second off.

To generate two alarms, one requires a 4 second clock with 1 second on, 1 second off, 1 second on, 1 second off and this will generate two alarms or two bells to indicate to the operator the various conditions during the one-man test operation. Furthermore, in FIG. 5, if the inquiry to box 502 or 504 is "NO" then one proceeds to box 505 which determines if the bell output is in the process of being pulsed. If the bell output is not being pulsed, then the inquiry to box 505 is "NO" and the program proceeds to box 510 which then proceeds to box 409 of FIG. 4.

Figure 6A:
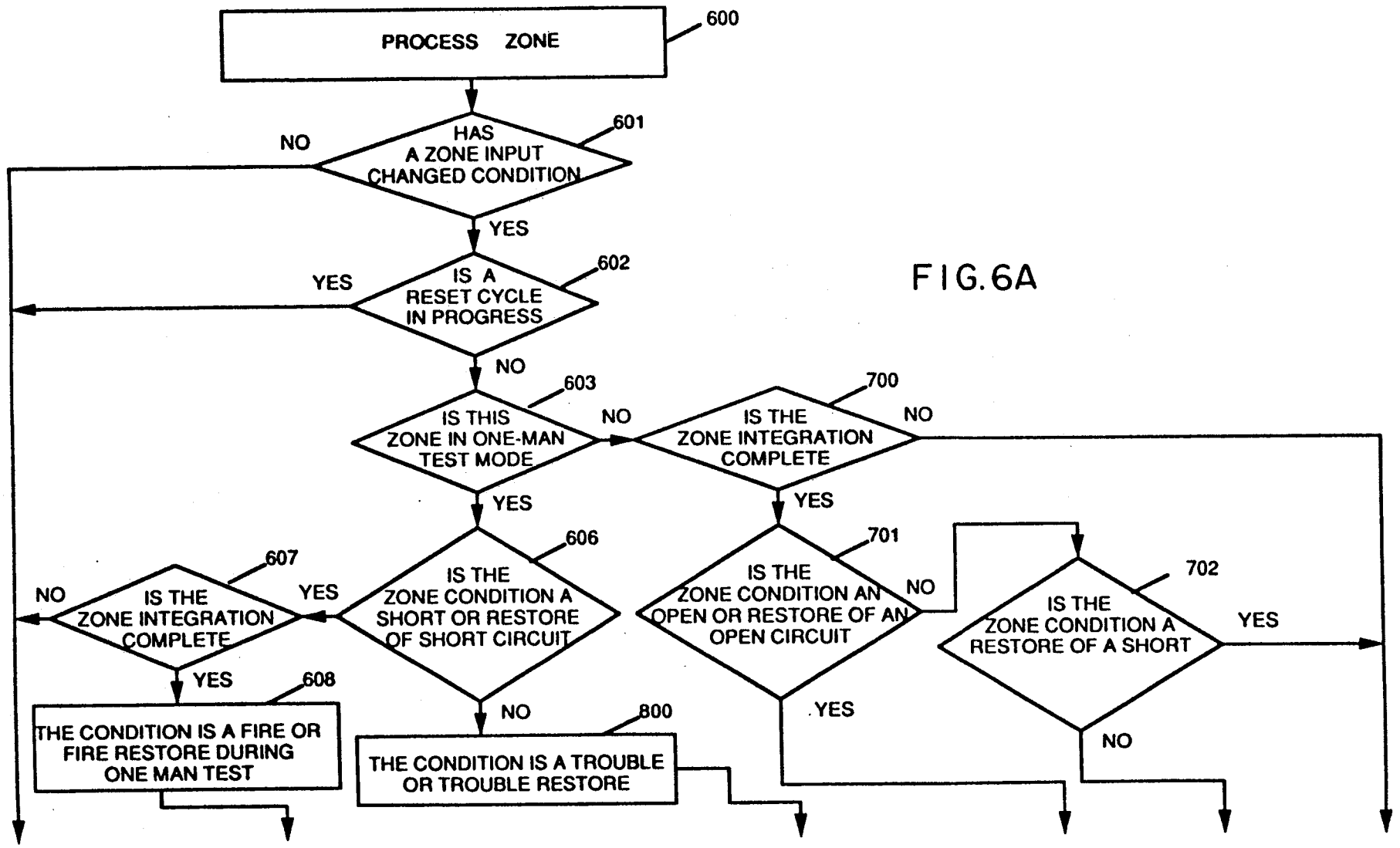
FIGS. 6A, 6B and 6C are a detailed flow chart depicting a zone mode implemented by this system.
Figure 6B:
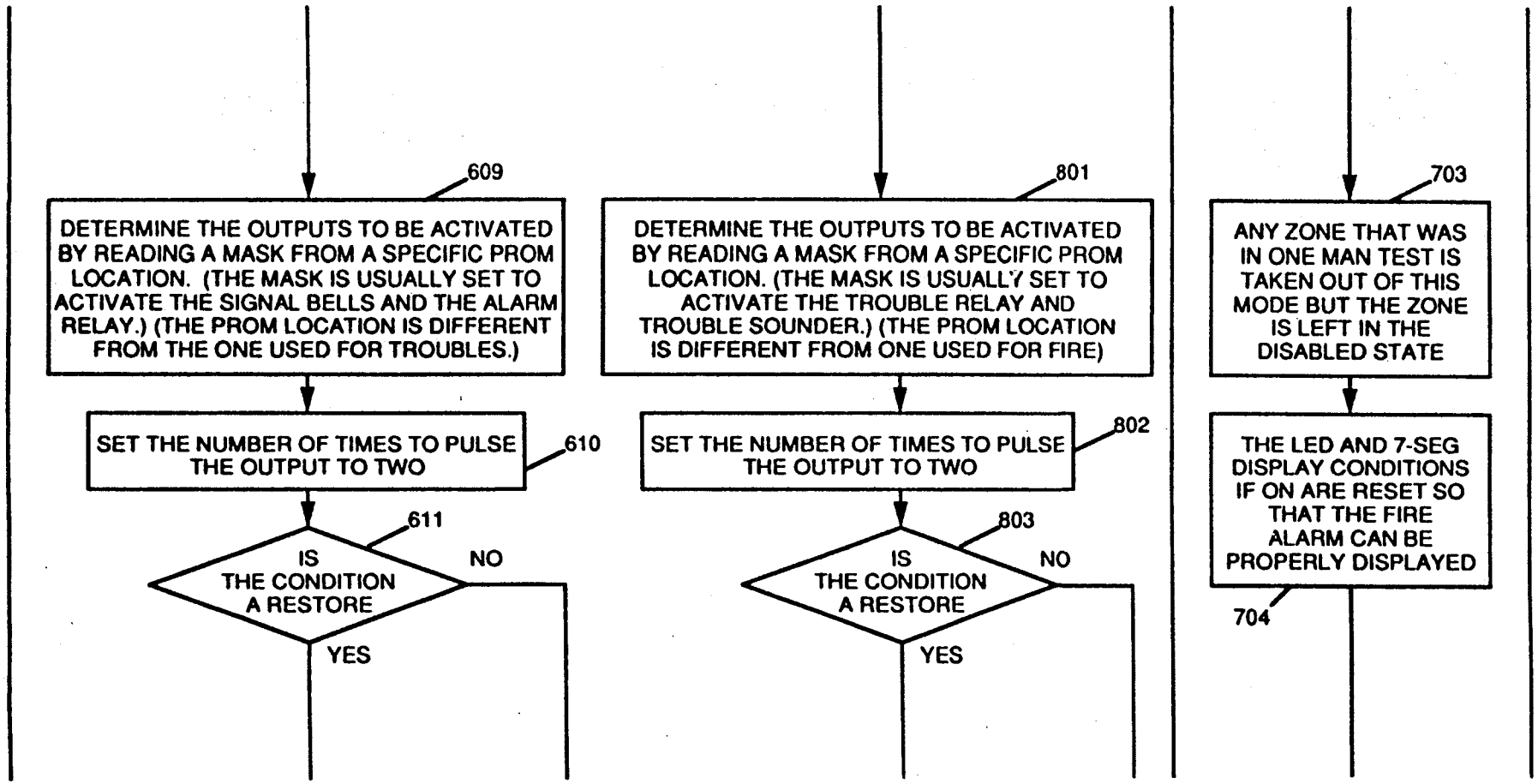
Figure 6C:
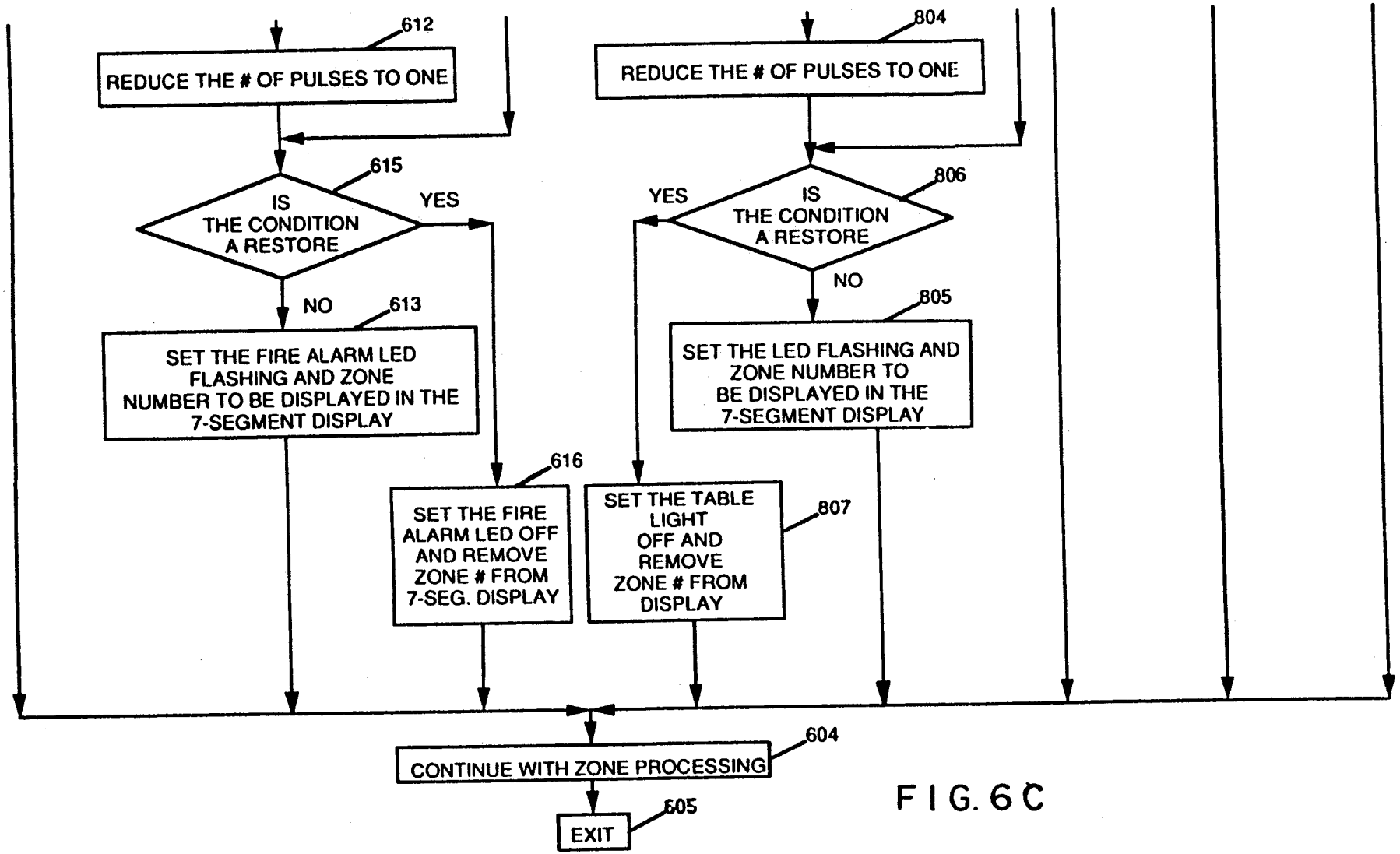

Referring to FIGS. 6A, 6B and 6C there is shown the process zone procedure as indicated in FIG. 4 by reference numeral 411. Thus, during this main line processing mode which is designated in FIG. 6A as 600, one enters module 601. Essentially, module 601 requires the microprocessor to determine whether the zone input has changed condition. As indicated above, when zones are scanned during the zone scanning mode as indicated by 400 of FIG. 4, the microprocessor stores the state of the zone in memory. The state of the zone can be normal, open or short. This is stored in memory.

Essentially, in step 601 the microprocessor looks for a change in zone condition. If there is no change in zone condition then the processing continues as indicated by module 604 and after all zones are processed one exits this routine as indicated by module 605. If there is a change in zone condition, the system must know whether this is a reset cycle in progress as indicated by module 602. If it is a reset cycle then one again continues with zone processing as indicated by module 604. The reset cycle could be a reset of the smoke detector mode as described above or any other reset cycle implemented by the system.

In any event, if it is not a reset cycle then module 603 is entered to determine "Is this zone in a one-man test mode?" Again, the microprocessor knows which zones have been disabled and knows that there is a one-man test mode. During zone processing, this information again is sought and affirmed by module 603. Since we are mainly concerned with the one-man test mode, we will now go to module 606 where module 606 indicates "Is the zone condition a short or a restore of short circuit?" As one will ascertain, an alarm condition causes a zone to go from a normal circuit condition to a short circuit condition If the alarm condition is not present some time later, the zone will go from a short condition to a normal condition.

When the system goes from a short to a normal, this is a restore condition Module 606 causes the microprocessor to determine whether the zone condition is a short or a restore. If the answer is yes it is a short or a restore then one enters module 607. Module 607 determines whether the zone integration time as discussed above is complete. If the zone integration time is complete, one enters module 608 which says the condition is a "fire" or a "fire restore" condition occurring during the one-man test. The "fire" condition occurs after the installer blows smoke into the smoke detector The "restore" condition would be when the smoke is cleared from the smoke chamber. In any event, module 608 causes entry into module 609 whereby the following occurs. In 609 the processor determines the outputs to be activated by reading a mask from the PROM location. This mask is usually set to activate the alarm bells and the alarm relay. The PROM locations accessed during the one-man test mode is different from the PROM locations accessed during the trouble mode as will be explained.

If there is a fire then as indicated above, the system went from normal to short, and hence as indicated by module 610, the number of times the alarm bells sound is two times. This is implemented by module 610. If the system is a "fire restore" where it went from short to normal then the bell or alarm only sounds one time. This is indicated by module 611 which determines that the system is a "fire restore" and module 612 causes the processor to pulse the bell one time. Basically the inquiry of box 611 pertains to setting the bell output for two pulses or for one pulse. If the inquiry of 611 is "NO", then two pulses will result on the bell output. Box 611 with an inquiry of "NO" proceeds to box 615 which is the same inquiry as box 611 but now it pertains to setting the condition of the LED's and 7 segment display. The output of module 612 is then directed to module 615 to again determine whether the condition is a restore. If the condition is not a restore then the operation goes to module 613 which states that the fire alarm LED on the display 71 of FIG. 1 is set to display the zone number at which the fire condition occurred. If it is a restore then one goes to module 616 where the fire alarm LED is set to the off state and the zone number is removed from the display. Once this occurs, one then continues with normal processing as indicated by module 604 and 605.

FIGS. 6A, 6B and 6C show the complete zone processing procedure. Thus, referring again to module 603, if there was not a one-man test then one would enter module 700 which states again "Is the zone integration complete?" If the zone integration is complete then one enters module 701 which states "Is the zone condition open or a restore of an opened circuit?" If it is an open or restore of an opened circuit then one continues with the processing as there is no problem. If the zone integration is not complete, one also continues with processing. If the zone condition is not an open or a restore of open circuit, one goes then to module 702. In module 702 the system then investigates whether the zone condition is a restore of a short circuit. If it is not then one enters module 703 which again indicates that any zone that was in the one-man test is taken out of this mode but the zone is left in the disable state and then one goes to module 704 which indicates that the displays, if on, are reset so that the fire alarm can be properly displayed.

The above-described sequence as performed in modules 702, 703 and 704 immediately states that if a fire is detected, the one-man test mode is ignored and the system displays the actual fire condition. Thus, it is seen that in the one-man test, those zones that have not been disabled will remain active. Should a real alarm condition occur, the test mode which is the one-man test mode, will be canceled and the system will revert to normal operation except that the disable zone will still be in the disable state until manually enabled.

In a similar manner, referring again to module 606 the determination made in 606 was whether the zone condition is a short or a restore of a short circuit. If it is not a short or a restore of a short circuit, one enters module 800 wherein module 800 the processor determines whether the condition is a "trouble" or "trouble restore". As one again will recollect if the installer blows smoke into the smoke detector, this is indicative of a fire during a one man test. In any event, the installer can also check the system for open circuits if a loop is opened. This is indicated by module 800. If a loop is opened then the loop cannot perform properly. The installer then by performing a one-man test would check all physical wiring and components in that zone to determine which one was opened as indicated by module 800. This condition indicates a "trouble" condition. After module 800 processing module 801 is entered which again states that the outputs to be activated are accessed by reading a mask from the PROM location. This mask is usually set to activate the "trouble" relay and the "trouble" alarm. The PROM location again is different from the one used for fire. Hence, as one can ascertain, during a trouble condition, the "trouble" alarm will pulse twice as indicated by the module 802.

Module 802 states that the system sets the number of times to pulse the output of the trouble alarm to two. Module 803 indicates whether the condition is a restore which means that the installer has fixed the open circuit. If it is a restore then the number of pulses are reduced to one as indicated by module 804 so that the trouble alarm is now sounded once. From module 804 one goes to module 806 where it is again investigated whether the condition is a restore. If it is not a restore then as indicated by module 805 the trouble zone is set on the display and the zone with the trouble or the open circuit is displayed. If it is a restore then one goes to module 807 where the trouble light is set to the Off condition and the zone number is removed from the display. The processor now continues with zone processing as indicated by module 604 and 605. As one can see, boxes 613 and 805 all proceed as shown in the flow chart diagram to box 604. Box 604 is labeled "continue with zone processing" but essentially also processes system supervisory conditions as is known. The box 604 goes to 605 to exit the routine. Box 704 proceeds to box 806 to exit via box 805, or 807 after the above functions are completed as shown. Thus, as seen the above-described system enables a one-man test mode whereby an installer can check the smoke detectors by blowing smoke in the detectors to determine whether they will operate properly. The system automatically, via the microprocessor, sets the specific times in order to allow the installer to accommodate this mode.

In any event, the zone may also be disabled and the installer can determine the position of an open circuit which is a trouble condition and which will be indicated as a trouble condition by two ringings of the trouble alarm. When the installer fixes the trouble condition, one ringing of the alarm will occur.

Thus, from the above, one can immediately understand the operation of the system, how the alarms are generated, how the microprocessor operates and is programmed accordingly. It is also understood that one can implement the above-described procedures by typical hardware such as registers, storage memory and a sequence generator or clock. The flow charts will enable one skilled in the art to immediately understand system operation from the above specification.

Figure 7:
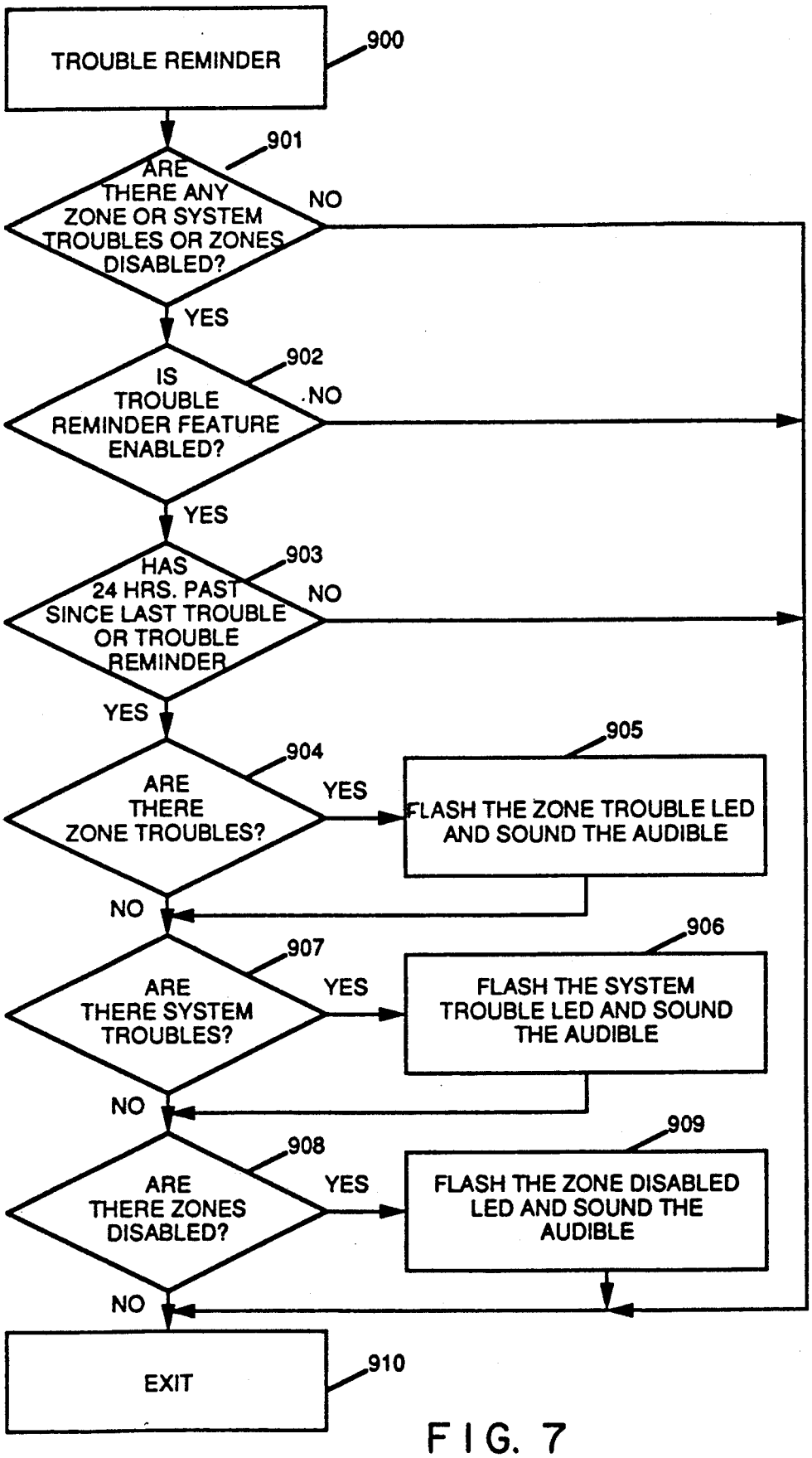
FIG. 7 is a detailed flow chart indicating a process trouble reminder mode implemented by this system.

Referring to FIG. 7, there is shown the main line processing step indicated in FIG. 4 as process trouble reminder or step 402. As shown in FIG. 7, the trouble reminder mode is entered into by the microprocessor at 900 which is equivalent to 402 of FIG. 4. During the trouble reminder mode, the microprocessor enters 901 where it stated "Are there any zone or system troubles or zones disabled?" If there are no zones disabled or no zone or system trouble, the subroutine is exited as indicated by module 910. If there is a zone disabled or a system trouble or a zone trouble then one enters module 902 where the trouble reminder feature is enabled. If this trouble reminder feature is not enabled, one again exits the program. If it is enabled then module 903 indicates "Has 24 hours passed since last trouble or trouble reminder?" The microprocessor as shown in FIG. 1 has an internal clock which essentially is a time-of-the-day clock. The purpose of the trouble reminder is to generate a complete log of all zones that are in trouble every 24 hours so that the user of the system knows that a zone is disabled and if any problem occurs on that zone there will not be a fire alarm or a trouble alarm indicated. Thus, if the trouble reminder feature is enabled, one goes into module 903 to determine whether 24 hours have passed. If 24 hours have not passed, one again exits. If 24 hours has passed, then one goes into module 904 which again states "Are there zone troubles?" If there are zone troubles then one enters module 905 where the zone trouble LED (ZT of FIG. 1) is flashed and the audible is sounded indicating a trouble. If there are no zones in trouble then the next question is "Are there system troubles?" as indicated by module 907. In FIG. 7 zone troubles in 904, systems troubles in 907 and disabled zones in 908 are not mutually exclusive and as such these conditions may exist in combination with each other. Therefore, box 905 proceeds to box 907 and box 906 proceeds to box 908.

As one can understand, intrusion detection systems, especially fire control systems, may have various system problems which may result and be caused by certain failures such as the failure of AC or power. There may be a sprinkler trouble, there may be a circuit problem, there may be a ground fault, there may be trouble with the telephone line, there may be a disabling of a certain device such as a smoke detector, there may be battery trouble or there may be a program failure. These are all system troubles. These troubles will appear on the numeric display, and as indicated in FIG. 1 by display LED ST for system trouble.

This is a conventional technique. If there are system troubles then as indicated by module 906 the system trouble light is flashed and there is a sound produced. If there are no system troubles then again the module 908 indicates whether there are zones disabled. If there are no zones disabled then the routine is exited as indicated by module 910. If there are zones disabled, the system must know this, and as indicated in module 909, the zone disabled LED as shown on the display of FIG. 1 and indicated as ZP is flashed and an audible alarm is sounded and then it is exited.

The above subroutine is also unique in the sense that one provides a trouble reminder every 24 hours by means of the microprocessor performing the routine of FIG. 7. Thus, the user of the system will know whether there are system troubles, zone troubles, where the system troubles are, where the zone troubles are and whether zones have been disabled. In this manner the user of the system is aware of all trouble conditions which exist a indicated above.

The remaining main line processing steps which have not been explained in regard to FIG. 4 are believed to be outside the scope of the present invention. As indicated above, the system operation has been described in great detail in regard to the flow charts whereby anyone familiar with programming can implement each and every system feature utilizing the circuit structure shown in FIG. 1.

In any event, it is also apparent that the above can be accomplished by the use of conventional components such as registers, memories, timers and so on. Thus, as one will understand there are many alternative embodiments which are deemed to be within the scope and spirit of the present invention as indicated by the claims appended hereto.

What is claimed is:

1. A fire control system including a plurality of zones, each zone associated with a smoke detector and arranged in at least a two wire loop, with said smoke detector positioned across said two wires to provide a low impedance condition upon detection of smoke indicative of a fire in that zone and to provide a high impedance when smoke is not detected, comprising biasing means for each loop to allow a current to flow in each loop indicative of a normal condition as distinguished from a low impedance condition across said loop as caused by said smoke detector;

multiplexer means having one input for each loop and having a control input to provide at an ouptut the condition of each loop in a selected sequence as controlled by a signal applied to said control input;

a microprocessor means having output means coupled to said multiplexer control input for controlling the same;

comparator means having inputs coupled to said multiplexer output and outputs coupled to said microprocessor means to enable said microprocessor to store the condition of each loop indicative of each zone and as to whether said loop is in a normal condition or a low impedance condition;

a keyboard coupled to said microprocessor means for causing said microprocessor to recognize selected key depressions indicative of a one man test mode, whereby when said mode is recognized said microprocessor means responds to low impedance conditions of selected loops as being intentionally implemented during a predetermined period to notify a user of said test mode in order to verify an intentional implemented low impedance condition of said loop as caused by an associated smoke detector with said microprocessor coupled to said biasing means to interrupt said current flow in said loop for a given period to allow said intentional condition to clear back to normal indicative of the completion of said one man test mode.

2. The system according to claim 1 further including audible output means coupled to said microprocessor means and responsive to the implementation of said intentional low impedance condition to provide a first audible signal indicative of said intentional low impedance condition during said one man test mode and to provide a second output audible signal when said low impedance condition is cleared.

3. The system according to claim 1 further including display means coupled to said microprocessor means for receiving a display signal from said microprocessor means indicative of said zone which provides said intentional low impedance condition.

4. The system according to claim 1 further including means associated with said microprocessor means and operative to monitor said key pad means to enable a user to select one or more zones in said plurality during said one man test mode.

5. The system according to claim 1 further including a PROM coupled to said microprocessor means and operative to store therein data indicative of said given period as selected according to the type of smoke detection employed with said zone.

6. The system according to claim 1 further including means within said microprocessor means for responding to an high impedance condition of any one of said zones to provide an indication of said high impedance condition during said one man test mode.

7. The system according to claim 6 further including second audible output means coupled to said microprocessor means and operative to provide a different audible signal indicative of said high impedance condition at any one of said zones.

8. A method of operating a fire control system in a one man test mode to enable a sole serviceman to test said system, said system including a plurality of zones, each zone associated with an alarm device whereby activation of said device causes a predetermined condition to appear at a zone output where said zones are monitored by a microprocessor, said microprocessor coupled to a key pad for causing said microprocessor to recognize commands from said key pad as inserted by said keys being depressed, comprising the steps of:

inserting a code in said key pad indicative of said one man test mode;

deciphering said code to inform said microprocessor of the selection of said one man test mode;

accessing a selected zone to cause said device to provide said predetermined condition;

causing said microprocessor to recognize said predetermined condition to verify said condition as implemented by accessing said device;

providing a predetermined signal upon recognition by said microprocessor to enable said serviceman to verify said system operation and removing said predetermined condition from said accessed zone; and enabling said microprocessor to recognize said removed predetermined condition to provide a second signal upon said removal to inform said serviceman of the same.

9. The system according to claim 8 further including the step of selecting one or more zones to be tested by depressing said key pad according to said selected zones.

10. The system according to claim 9 further including the steps of deciphering said selected zones to inform said microprocesor of the same.

11. The method according to claim 8 wherein said alarm device is a smoke detector with said predetermined condition caused by blowing smoke into said smoke detector when accessing said zone.

12. The method according to claim 11 wherein said predetermined condition is caused by opening a zone during said test mode to cause said microprocessor to recognize said opening as said predetermined condition.

13. The method according to claim 11 wherein the step of removing said predetermined condition includes blowing air into said smoke detector to dispel smoke from said chamber of said detector.

14. The method according to claim 13 wherein the steps of removing said predetermined condition includes removing power from said smoke detector for a given selected period of a time sufficient to enable said smoke detector to revert to a non-alarm condition after blowing said air into said detector.

15. In a fire control system of the type including a plurality of zones to be monitored, each zone associated with a smoke detector and arranged as a two wire loop with said smoke detector positioned across said two wires to provide a short upon detection of smoke, with each zone monitored by processing means operative to scan said zones in a determined sequence to respond to the condition of each loop in each zone in order to determine the presence of an alarm in said zone manifested by said smoke detector activation providing a short across said wires, whereby if said alarm continues said processing means will provide an output indicative of said alarm, the combination therewith of apparatus for testing system operation in a one man test mode, comprising:

first means coupled to said processing means and operative to inform said processing means of said selection of said one ma test mode;

means responsive to said selection to cause said processing means to wait a given period before providing an alarm output during said one man test mode to enable a serviceman to intentionally provide an alarm in a zone by activating said associated smoke detector;

second means coupled to said processing means operative to cause said processing means to provide an output indicative of said intentionally provided alarm to thereby notify said serviceman of the same.

16. The combination according to claim 15 wherein said first means includes a key pad coupled to said processing means for inserting a code via said pad indicative of said one man test mode.

17. The combination according to claim 15 wherein said second means includes an audible output means to enable said serviceman to be notified.

18. The combination according to claim 15 further including display means coupled to said processing means for displaying the zone location upon which said intentional alarm is provided.

19. The combination according to claim 15 further including third means coupled to said processing means to automatically restore said intentional alarm to a non-alarm condition during said test mode and during a predetermined time period.

20. The combination according to claim 19 wherein said third means includes means coupled to said smoke detector means for removing operating potential therefrom during said predetermined period.

* * * * *